US005314860A

United States Patent [19]

Vanmaele et al.

[11] Patent Number: 5,314,860

[45] Date of Patent: May 24, 1994

[54] METHOD OF STABILIZING A MATERIAL FOR USE IN A THERMAL DYE TRANSFER IMAGING PROCESS

[75] Inventors: Luc J. Vanmaele, Lochristi; Wilhelmus Janssens, Aarschot, both of Belgium

[73] Assignee: Agfa-Gevaert, N.V., Mortsel, Belgium

[21] Appl. No.: 821,564

[22] Filed: Jan. 16, 1992

[30] Foreign Application Priority Data

Feb. 4, 1991 [EP] European Pat. Off. ..... 90200218.5

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,752,534 6/1988 Koshizuka et al. ..... 428/500

4,855,281 8/1989 Byers ..... 503/227

*Primary Examiner*—B. Hamilton Hess

*Attorney, Agent, or Firm*—Breiner & Breiner

[57] ABSTRACT

This invention relates to a method of stabilizing a material for use in a thermal dye transfer imaging process, characterized in that a compound satisfying the formula A-X wherein: A stands for acyl, and X stands for the conjugated base of an acid with a pKa≦14, is included in the dye-donor element and/or in the receiving element for use in carrying out said process.

21 Claims, No Drawings

METHOD OF STABILIZING A MATERIAL FOR USE IN A THERMAL DYE TRANSFER IMAGING PROCESS

The present invention relates to a method of stabilizing a material for use in a thermal dye transfer diffusion process as well as to a dye-donor element and a receiving element for use in carrying out said process.

Thermal dye transfer diffusion processes have been developed to make prints from electronic pattern information signals, e.g. from pictures that have been generated electronically by means of a colour video camera. To make such prints the electronic picture can be subjected to colour separation with the aid of colour filters. The different color selections thus obtained can then be converted into electric signals, which can be processed to form cyan, magenta, and yellow electrical signals. The resulting electrical colour signals can then be transmitted to a thermal printer. To make the print a dye-donor element having repeated separate blocks of cyan, magenta, and yellow and optionally black dye is placed in face-to-face contact with a receiving sheet and the resulting sandwich is inserted between a thermal printing head and a platen roller. The thermal printing head, which is provided with a plurality of juxtaposed heat-generating resistors, can selectively supply heat to the back of the dye-donor element. For that purpose it is heated up sequentially in correspondence with the cyan, magenta, and yellow electrical signals, so that dye from the selectively heated regions of the dye-donor element is transferred to the receiving element and forms a pattern thereon, the shape and density of which are in accordance with the pattern and intensity of the heat supplied to the dye-donor element.

A dye-donor element for use according to thermal dye transfer diffusion processes usually comprises a very thin support, e.g. a polyester support, which is coated on both sides with an adhesive or subbing layer, one adhesive or subbing layer being covered with a slipping layer that provides a lubricated surface against which the thermal printing head can pass without suffering abrasion, the other adhesive layer at the opposite side of the support being covered with a dye/binder layer, which contains the printing dyes in a form that can be released in varying amounts depending on, as mentioned above, how much heat is applied to the dye-donor element. The dye/binder layer can be a monochrome dye layer or it may comprise sequential repeated separate blocks of different dyes like e.g. cyan, magenta, and yellow dyes, when a dye-donor element comprising three or more primary colour dyes is used, a multicolour image can be obtained by sequentially performing the dye transfer process steps for each colour. Any dye can be used in such a dye/binder layer provided it is easily transferable to the dye-image-receiving layer of the receiving sheet by the action of heat.

A dye-image receiving element for use according to thermal dye transfer diffusion processes usually comprises a support, e.g. paper or a transparant film, coated with a dye-image receiving layer, into which the dye can diffuse more readily. An adhesive layer may be provided between the support and the receiving layer.

It is of course important that the properties of the materials used in carrying out the thermal dye transfer diffusion process be maintained in the best manner possible. On storage all kinds of changes may actually occur, partly under the influence of ambient conditions, such as the temperature and the moisture content of the air. These changes may result in that no constant print quality can be ensured or that the print quality deteriorates on storage. As a result of hydrolysis, for instance, the dyes used may sustain a loss of colour intensity or show undesirable secondary absorptions. In consequence thereof, the quality of the product is substantially damaged. It is self-explanatory that this is undesirable and, accordingly, it is expedient to aim at an optimum stability of the products used in a thermal dye transfer imaging process.

It is therefore an object of the present invention to provide a better stability of the materials used in a thermal dye transfer diffusion process.

This and other objects, which will be described hereinafter, can be obtained by including a compound corresponding to the formula A-X wherein A stands for acyl and X stands for the conjugated base of an acid with a $pKa \leqq 14$, in the dye-donor element and/or in the receiving element for use in carrying out the thermal dye transfer diffusion process.

Compounds A-X exert a stabilizing effect on the material in which they have been incorporated. This effect particularly applies with respect to other components also present therein which are easily affected, e.g., by hydrolysis or oxidation, bringing about such a change of those compounds that they no longer perform their intended function or no longer perform that function in the right manner.

The above described stabilizing effect can be explained more specifically on the basis of a preferred use of the inventive compounds A-X, namely, in combination with thermally transferable dyes containing groups susceptible to hydrolysis. In the presence of moisture such dyes are easily subjected to changes resulting in that the absorption spectrum of the dye can be altered or the dye intensity can diminish, which is of course undesirable. Examples of groups susceptible to hydrolysis, which groups may occur in thermally transferable dyes, are amide groups, ester groups, sulfonamide groups, succinimide groups and carbamate groups. European patent publications nos. EP 400706 en EP 384990 and EP 444327 describe a large number of dyes containing such groups susceptible to hydrolysis. Those dyes have particularly suitable properties for use in a thermal dye transfer process. When the present compounds A-X are used in combination with such dyes, a remarkable stabilizing effect is obtained, as will be shown in the examples given below.

As stated before, compounds A-X can be incorporated both in the dye-donor element and/or in the receiving element. Many of those compounds, if initially present in the dye-donor element, are co-transferred in carrying out the thermal dye transfer diffusion process, after which, so to say, they continue their stabilizing effect in the receiving element. It has then been observed that those compounds also promote the thermal transfer of the dyes, thus acting as thermal solvents, as a result of which a larger amount of dye can be transferred, or the dye transfer can be carried out more rapidly. This is of course favorable to the dye density to be obtained or to the rate of carrying out the thermal dye transfer imaging process.

Finally, it has been observed that components A-X act as release agents in that they facilitate the separation of the receiving element from the dye-donor element after the thermal transfer has taken place.

The compounds having a stabilizing effect as used according to the invention satisfy the earlier defined formula A-X, wherein A stands for acyl, and X stands for the conjugated base of an acid with a pKa≦14. Here acyl means the organic radical derived from an organic acid by removal of the hydroxyl group. Specific meanings of X will appear from the further description and from the examples of specific compounds given therein.

Symbol A generally satisfies one of the formulae R—CO—, R—$SO_2$—, or $R_1R_2PO$— wherein:

R stands for substituted or unsubstituted alkyl, substituted or unsubstituted aralkyl, substituted or unsubstituted cycloalkyl, substituted or unsubstituted alkenyl or substituted or unsubstituted aryl, and Symbol A generally satisfies one of the formulae R—CO—, R—$SO_2$—, or $R_1R_2PO$— wherein:

R stands for substituted or unsubstituted alkyl, substituted or unsubstituted aralkyl, substituted or unsubstituted cycloalkyl, substituted or unsubstituted alkenyl or substituted or unsubstituted aryl, and $R_1$ and $R_2$ each independently represent substituted or unsubstituted alkyl, substituted or unsubstituted cycloalkyl, substituted or unsubstituted alkenyl, substituted or unsubstituted aralkyl, substituted or unsubstituted aryl, substituted or unsubstituted alkyloxy, substituted or unsubstituted aryloxy, substituted or unsubstituted alkylthio, substituted or unsubstituted arylthio, substituted or unsubstituted amino or a substituted or unsubstituted heterocyclic group or $R_1$ and $R_2$ together represent the necessary atoms to close a 5- or 6-membered ring.

X may be chloride, bromide, aliphatic or aromatic carboxylate, phenolate, aromatic or aliphatic sulfonate or sulfate, sulfonamide.

A preferred class of compounds A-X are cyclic and acyclic anhydrides and mixed anhydrides.

In case of A-X being acyclic anhydride, A-X generally corresponds to formula 1: $R_3$—CO—O—CO—$R_4$ wherein $R_3$ and $R_4$ each independently represent substituted or unsubstituted alkyl, or substituted or unsubstituted aryl.

Specific examples of suitable compounds within this formula 1 are the compounds in which $R_3$ and $R_4$ have the meanings given below:

| $R_3$ | $R_4$ | |
|---|---|---|
| $CH_3$ | $CH_3$ | |
| $C_6H_5$ | $C_6H_5$ | (compound g) |
| p-$NO_2C_6H_4$ | p-$NO_2C_6H_4$ | |
| $C_{17}H_{35}$ | $C_{17}H_{35}$ | |
| $C_2H_5$ | $C_2H_5$ | |
| $C_3H_7$ | $C_3H_7$ | |
| $C_4H_9$ | $C_4H_9$ | |
| $C_{15}H_{31}$ | $C_{15}H_{31}$ | |
| $C_{12}H_{25}$ | $C_{12}H_{25}$ | |
| $CH_2Cl$ | $CH_2Cl$ | |
| $CH(CH_3)_2$ | $CH(CH_3)_2$ | |

More preferred cyclic anhydrides satisfy formula 2.

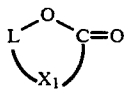

(formula 2)

wherein L represents C=O or $SO_2$ and $X_1$ represents the atoms necessary to complete a saturated or unsaturated ring which may be substituted or not.

A subformula within the above formula 2 is the formula 3.

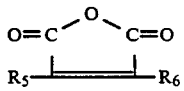

(formula 3)

wherein $R_5$ and $R_6$ each independently represent hydrogen, halogen, substituted or unsubstituted alkyl, substituted or unsubstituted alkenyl, or substituted or unsubstituted aryl, or together represent the atoms necessary to close an aliphatic or aromatic carbocyclic or heterocyclic ring, which may contain further substituents.

Specific examples of suitable compounds within the above formulae 2 and 3 are the compounds in which $R_5$ and $R_6$ have the meanings given below:

| $R_5$ | $R_6$ |
|---|---|
| $CH_3$ | H |
| $C_2H_5$ | H |
| $CH_3$ | $CH_3$ |

and further the following compounds

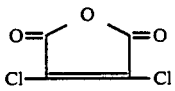

compound a

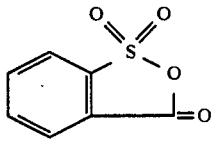

compound b

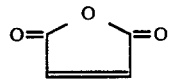

compound c

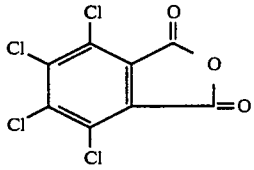

compound d

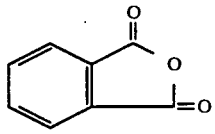

compound e

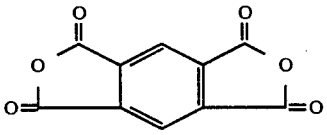

compound f

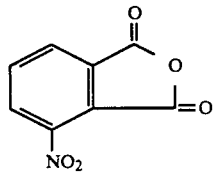

compound h

-continued compound i

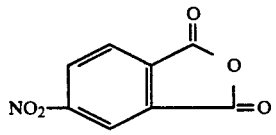

compound j

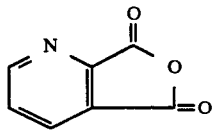

compound k

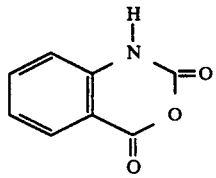

compound l

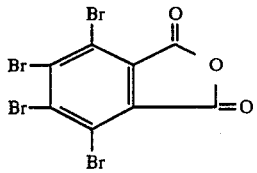

compound m

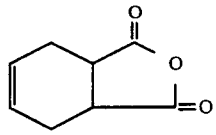

compound n

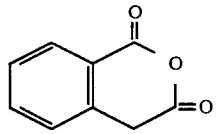

compound o

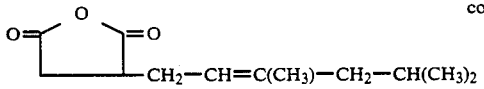

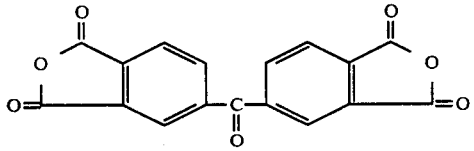

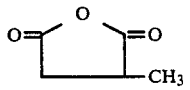

Another preferred class of compounds A-X are those corresponding to formula 4.

(formula 4)

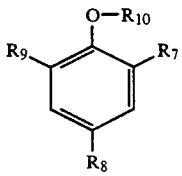

wherein:

$R_7$ represents hydrogen, an alkyl group, an aryl group, an alkenyl group, an aralkyl group, a cycloalkyl group, which groups may be substituted or $COOR_{11}$;

$R_8$ represents hydrogen, halogen, nitro, cyano, carbonamido, sulfonamido, acylamino, sulfonylamino, an alkyl group, an aryl group, an alkoxy group, a thioalkoxy group, an amino group or an alkenyl group, which groups may be substituted;

$R_9$ represents hydrogen, an alkyl group or an alkenyl group, which groups may be substituted;

$R_{10}$ represents $—COR_{12}$, $SO_2R_{12}$;

$R_{11}$ represents hydrogen, an alkyl group, an aryl group or an acyl group, which groups may be substituted;

$R_{12}$ represents an alkyl group or an aryl group, which groups may be substituted.

As example of a compound according to the above formula 4 the compound wherein $R_7$ is COOH, $R_8$ and $R_9$ both are hydrogen and $R_{10}$ is acetyl (compound p) is given.

Another preferred class of compounds A-X are those corresponding to $R_{13}SO_2Cl$ wherein $R_{13}$ is a cyclic or acyclic alkyl group, an aryl group or an aralkyl group which groups may be substituted. Examples of $R_{13}$ are phenyl (compound t), tolyl (compound q), methyl, butyl, m-nitrophenyl (compound v), p-acetylaminophenyl (compound x), o,p-dinitrophenyl (compound y), p-bromophenyl (compound w), p-chlorophenyl (compound r), m,p-dichlorophenyl (compound s), p-nitrophenyl (compound u) and p-methoxyphenyl.

Another preferred class of compounds A-X are those corresponding to $R_{14}R_{15}N—SO_2—R_{16}$ wherein $R_{14}$ represents $COR_{17}$ or $SO_2R_{17}$ and $R_{15}$, $R_{16}$ and $R_{17}$ (same or different) represent substituted or non-substituted, cyclic or acyclic, alkyl or aryl group.

The invention is not limited to the classes of compounds and the examples shown above.

All compounds A-X shown above are commercially available or, if not, can easily be prepared according to synthetic procedures known to those skilled in the art of organic synthesis.

Compounds A-X for use according to the present invention may also form part of a polymeric structure. This may be a homopolymer, but is preferably a copolymer, e.g., a random copolymer which, in addition to other recurring units, also contains units derived from a compound A-X. The copolymers containing units derived from a compound A-X may also be block copolymers or graft copolymers. Such a polymer exerts an excellent stabilizing activity in the material in which it is incorporated, donor as well as acceptor material. If the polymer is present in the dye-donor element, however, different from a non-polymeric compound A-X, it will not be co-transferred to the receiving element in carrying out the thermal dye transfer imaging process, so that it will not continue its stabilizing activity in the latter element. During use of a compound A-X in polymer form in the dye-donor element the earlier mentioned dye transfer promoting activity is actually not observed either. A polymeric compound A-X incorporated in the receiving element can be combined with a donor element containing a non-polymeric compound A-X that co-transfers to the receiving element while being heated.

Compounds A-X according to the present invention can also contain a group that is released from the compound A-X in exerting its stabilizing effect and that once released has a further stabilizing effect on the thermal transfer material, acting for example as a UV-absorber, a singlet oxygen quencher, an antioxidans or a peroxide quencher.

The present compound A-X can be included in the dye-donor layer of the dye-donor element in an amount of 10–1000 mg/m$^2$, preferably in an amount of 20–200 mg/m$^2$. If the present compound is applied in the receiving layer of the receiving element, then the amount used generally lies in the range of 50–2000 mg/m$^2$, preferably in the range of 100–1000 mg/m$^2$.

The dye-donor element for use in carrying out the thermal dye transfer diffusion process generally contains separate blocks of a cyan, a magenta and a yellow dye, which blocks are applied to a suitable support in the form of a dye-donor layer. It is also possible, however, to produce a so-called black dye-donor layer for making black-and-white transfer prints instead of coloured transfer prints. Such a black dye-donor layer may contain a cyan, a magenta and a yellow dye in the same block or area. Also in such a material the above-described favourable effects of the invention are obtained and, e.g., a better stability of dyes susceptible to hydrolysis can be ensured, resulting in the production of a deep black transfer print, which remains substantially unchanged on storage.

The dye/binder layer of the dye-donor element for thermal dye transfer is formed preferably by adding the dyes, the binder resin, compound A-X, in case the latter compound is used in the dye-donor layer, and other optional components to a suitable solvent or solvent mixture, dissolving or dispersing the ingredients to form a composition that is applied to a support, which may have been provided first with an adhesive layer, and dried.

The dye/binder layer thus formed has a thickness of about 0.2 to 5.0 μm, preferably 0.4 to 2.0 μm, and the amount ratio of dye to binder is from 9:1 to 1:3 by weight, preferably from 2:1 to 1:2 by weight.

The binder resin can be chosen from cellulose derivatives like ethyl cellulose, hydroxyethyl cellulose, ethylhydroxy cellulose, ethylhydroxyethyl cellulose, hydroxylpropyl cellulose, methyl cellulose, cellulose acetate, cellulose acetate formate, cellulose acetate propionate, cellulose acetate butyrate, cellulose acetate pentanoate, cellulose acetate hexanoate, cellulose acetate heptanoate, cellulose acetate benzoate, cellulose acetate hydrogen phthalate, cellulose triacetate, and cellulose nitrate; vinyl-type resins like polyvinyl alcohol, polyvinyl acetate, polyvinyl butyral, polyvinyl pyrrolidone, polyvinyl acetoacetal, and polyacrylamide; polymers and copolymers derived from acrylates and acrylate derivatives, such as polyacrylic acid, polymethyl methacrylate, and styrene-acrylate copolymers; polyester resins; polycarbonates; poly(styrene-co-acrylonitrile); polysulfones; polyphenylene oxide; organosilicones such as polysiloxanes; epoxy resins and natural resins, such as gum arabic.

The binder resin can be added to the dye/binder layer in widely varying concentrations. In general, good results are obtained with 0.1 to 5 g of binder resin per m$^2$ of coated support.

The dye/binder layer contains from 0.05 to 1 g of dye per m$^2$.

The dye/binder layer can also contain other components such as e.g. curing agents, additional preservatives, and other ingredients, which have been described exhaustively in EP-A 0,133,011, EP-A 0,133,012, EP-A 0,111,004, and EP-A 0,279,467.

Any material can be used as the support for the dye-donor element provided it is dimensionally stable and capable of withstanding the temperatures involved, i.e. up to 400° C. over a period of up to 20 msec, and is yet thin enough to transmit heat supplied to one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper, and condenser paper. Preference is given to a support comprising polyethylene terephthalate. In general, the support has a thickness of 2 to 30 μm. If desired, the support can be coated with an adhesive or subbing layer.

The dye/binder layer of the dye-donor element can be applied to the support by coating or by printing techniques such as a gravure process.

A dye barrier layer comprising a hydrophilic polymer can be provided between the support and the dye/-binder layer of the dye-donor element to improve the dye transfer densities by preventing wrong-way transfer of dye into the support. The dye barrier layer may contain any hydrophilic material that is useful for the intended purpose. In general, good results have been obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethylene imine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP-A 0,227,091 and EP-A 0,228,065. Certain hydrophilic polymers e.g. those described in EP-A 0,227,091 also have an adequate adhesion to the support and the dye/binder layer, thus eliminating the need for a separate adhesive or subbing layer. These particular hydrophilic polymers used in one single layer in the dye-donor element thus perform a dual function, hence are referred to as dye barrier/subbing layers.

Preferably, the reverse side of the dye-donor element can be coated with a slipping layer to prevent the printing head from sticking to the dye-donor element. Such a slipping layer would comprise a lubricating material such as a surface-active agent, a liquid lubricant, a solid lubricant, or mixtures thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, and fluoroalkyl $C_2$–$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids and fatty acid esters. Suitable slipping layers have been described in e.g. EP-A 0,138,483, EP-A 0,227,090, U.S. Pat. No. 4,567,113, U.S. Pat. No. 4,572,860, and U.S. Pat. No. 4,717,711.

The dye-donor element can be used in sheet form or in the form of a continuous roll or ribbon.

The support of the receiving element to be used in combination with the dye-donor element may be a transparent film of e.g. polyethylene terephthalate, a polyether sulfone, a polyimide, a cellulose ester, and a polyvinyl alcohol-coacetal. The support may also be a reflecting one such as e.g. baryta-coated paper, polyethylene-coated paper, and white polyester, i.e. white-pigmented polyester.

To avoid poor absorption of the transferred dye to the support of the receiver sheet, this support must be coated with a special surface, generally known as dye-image-receiving layer, into which the dye can diffuse more readily. The dye image-receiving layer may comprise e.g. a polycarbonate, a polyurethane, a polyester, a polyamide, polyvinyl chloride, polystyrene-coacrylonitrile, polycaprolactone, and mixtures thereof. Suitable dye-image-receiving layers have been described in e.g. EP-A 0,133,011, EP-A 0,133,012, EP-A 0,144,247, EP-A 0,227,094 and EP-A 0,228,066.

The compound A-X according to the present invention may be incorporated into the dye-image-receiving layer resulting in obtaining the favourable effects described above. For improving the fastness to light and other stabilities of the recorded images UV-adsorbers and/or antioxidants may be incorporated into the dye-image-receiving layer too.

It is generally known to use a releasing agent that aids in separating the receiving element from the dye-donor element after transfer. Solid waxes, fluorine- or phosphate-containing surfactants, and silicone oils can be used as releasing agent. A suitable releasing agent has been described in e.g. EP-A 0,133,012 and JP 85/19138. A preferred releasing agent is a copolymer of polysiloxane and polyether or a blockcopolymer thereof.

In carrying out the dye transfer process the dye layer of the dye-donor element is placed in face-to-face relation with the dye-receiving layer of the receiving element and heat is applied image-wise from the back of the donor element. The transfer of the dye is accomplished by heating for milliseconds at a temperature that may be as high as 400° C.

The dye transfer image can be a monochrome image, a black image or a multicolour image. A multicolour image can be obtained by using a dye-donor element containing three or more primary colour dyes, e.g. cyan, magenta and yellow, and sequentially performing the process steps described above for each colour. The sandwich of dye-donor element and receiving element is formed and heat is supplied by the thermal printing head. After the first dye has been transferred, the elements are peeled apart. A second dye-donor element or another area of the dye-donor element with a different dye is then brought in register with the receiving element and the process is repeated. The third colour and optionally further colours are obtained in the same manner.

In addition to thermal printing heads, laser light, infrared flash, or heated pins can be used as a heat source for supplying the heat energy. Thermal printing heads that can be used to transfer dye from the dye-donor elements of the present invention to a receiving element are commercially available. Suitable thermal printing heads are e.g. a Fujitsu Thermal head (FTP-040 MCS001), a TDK Thermal Head F415 HH7-1089, and Rohm Thermal Head KE 2008-F3.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically addressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

In order to eliminate the shortcoming of large unused portions remaining on each dye element, the following alternatives known under the abbreviation of MUST (i.e. multi-use transfer) can be applied: an equal speed mode in which a donor and a receiver element are moved at the same speed for using the donor element in repetition and a differential mode in which the running speed of the donor element is made lower than that of the receiver element so that the overlapping used portions of the donor element at the first use and the second use are shifted little by little. A description of multi-use application can be found in GB 2222692.

The following examples illustrate the present invention without limiting, however, the scope thereof.

EXAMPLE 1

This example illustrates the stabilizing effect of a number of compounds A-X, which are initially present in the dye-donor element, on the dye which has been thermally transferred to the receiving element.

A dye-donor element for use according to thermal dye transfer was prepared as follows.

To avoid sticking of the dye-donor element to the thermal printing head the rear side of a 5 μm polyethylene terephthalate support was provided first with a solution for forming a slipping layer, said solution comprising 10 g of co(styrene/acrylonitrile) comprising 104 styrene units and 53 acrylonitrile units, which copolymer is sold under the trade mark LURAN 378 P by BASF AG, D-6700 Ludwigshafen, Germany, 10 g of a 1% solution of polysiloxane polyether copolymer sold under the trade mark TEGOGLIDE 410 BY TH. GOLDSCHMIDT AG, D-4300 Essen 1, Goldschmidtstr. 100, Germany, and sufficient ethyl methyl ketone solvent to adjust the weight of the solution to a total of 100 g. From this solution a layer having a wet thickness of 15 μm was printed by means of a gravure press. The resulting layer was dried by evaporation of the solvent.

50 mg of dye as identified hereinafter, 50 mg of binder (cellulose acetate butyrate having an acetyl content of 29.5% and a butyryl content of 17%; Tg 161° C.; melting range: 230°-240° C.) and 25 mg of a compound A-X as identified hereinafter (or, in case two compounds A-X were used, 15 mg of each of them) were dissolved in 10 ml of ethyl methyl ketone. The resulting ink-like composition was coated by means of a doctor knife on the front side of the polyethylene terephthalate support at a wet layer thickness of 100 μm and dried.

A commercially available Hitachi material (VY-S100A-paper ink set) was used as receiving element.

The dye-donor element was printed in combination with the receiving element in a Hitachi colour video printer VY-100A.

The receiving element was separated from the dye-donor element and stored under different conditions of temperature and relative humidity, as set forth below, for some days, as also set forth below.

Each time the following values were determined:

the percentage of loss (or profit, indicated by +) of maximum transmission density (−% tra);

the percentage of loss (or profit, indicated by +) of maximum reflection density (−% re);

the absorption values in reflection behind a red, a green and a blue filter, respectively (red; green; blue).

The measurements in transmission were conducted on a Macbeth Quanta Log (trade mark) densitometer and the measurements in reflection were conducted on a Macbeth RD 919 (trade mark) densitometer.

In the above-described manner experiments were conducted with four dyes, namely:

with a cyan dye of the following formula (experiments 1);

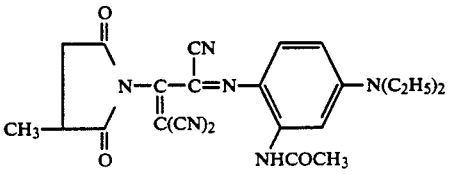

with a cyan dye of the following formula (experiments 2);

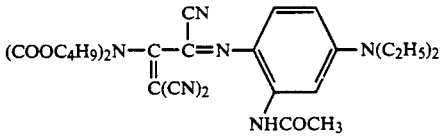

with a yellow dye of the following formula (experiments 3);

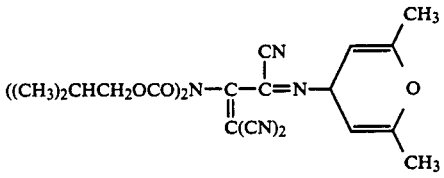

with a magenta dye of the following formula (experiments 4); and

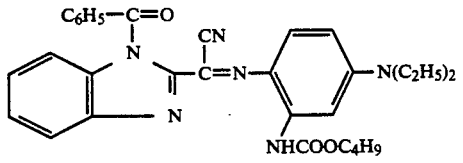

with a cyan dye of the following formula (experiments 5).

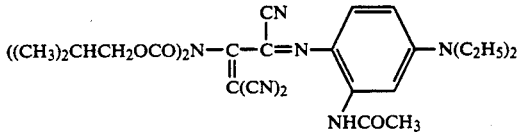

The tested compounds A-X were selected from the compounds a-y shown above.

The results obtained are given below. The results listed on the left-hand side were obtained by storing the print at a temperature of 57° C. and a relative humidity of 34%, and the results listed on the right-hand side were obtained by storing the print at a temperature of 45° C. and a relative humidity of 70%.

experiment 1; comparison without A-X

| days | -% tra | -% re | red | green | blue | days | -% tra | -% re | red | green | blue |
|---|---|---|---|---|---|---|---|---|---|---|---|
| 0 | | | 150 | 37 | 23 | 0 | | | 150 | 39 | 24 |
| 3 | 7 | 0 | 150 | 47 | 29 | 7 | 5 | +1 | 150 | 47 | 29 |
| 6 | 9 | 0 | 150 | 50 | 31 | 14 | 7 | +4 | 150 | 48 | 30 |
| 9 | 10 | 0 | 150 | 53 | 32 | 21 | 8 | +5 | 150 | 49 | 31 |
| 12 | 13 | 0 | 150 | 56 | 34 | 28 | 8 | +5 | 150 | 50 | 31 |

experiment 1; compound a

| days | -% tra | -% re | red | green | blue | days | -% tra | -% re | red | green | blue |
|---|---|---|---|---|---|---|---|---|---|---|---|
| 0 | | | 150 | 36 | 23 | 0 | | | 150 | 37 | 23 |
| 3 | 0 | 2 | 150 | 36 | 24 | 7 | +3 | +16 | 150 | 40 | 25 |
| 6 | 0 | 2 | 150 | 37 | 24 | 14 | +4 | +16 | 150 | 41 | 25 |
| 9 | 1 | 3 | 150 | 40 | 25 | 21 | +3 | +13 | 150 | 42 | 26 |
| 12 | 2 | 4 | 150 | 42 | 27 | 28 | +3 | +13 | 150 | 42 | 26 |

experiment 1; compound b

| days | -% tra | -% re | red | green | blue | days | -% tra | -% re | red | green | blue |
|---|---|---|---|---|---|---|---|---|---|---|---|
| 0 | | | 140 | 43 | 27 | 0 | | | 150 | 41 | 25 |
| 3 | 1 | 1 | 140 | 44 | 28 | 7 | +1 | 3 | 150 | 43 | 27 |
| 6 | 2 | 3 | 140 | 44 | 28 | 14 | +2 | 3 | 150 | 44 | 28 |
| 9 | 2 | 3 | 140 | 45 | 29 | 21 | +1 | 4 | 145 | 43 | 28 |
| 12 | 3 | 4 | 140 | 44 | 29 | 28 | 2 | 4 | 145 | 43 | 28 |

experiment 1; compound c

| days | -% tra | -% re | red | green | blue | days | -% tra | -% re | red | green | blue |
|---|---|---|---|---|---|---|---|---|---|---|---|
| 0 | | | 150 | 35 | 23 | 0 | | | 150 | 35 | 23 |
| 3 | 5 | 2 | 150 | 41 | 27 | 7 | 3 | 5 | 150 | 39 | 26 |
| 6 | 2 | 5 | 150 | 43 | 28 | 14 | 9 | 7 | 150 | 47 | 30 |
| 9 | 9 | 8 | 150 | 46 | 29 | 21 | 10 | 9 | 150 | 47 | 30 |
| 12 | 10 | 10 | 150 | 48 | 30 | 28 | 12 | 9 | 150 | 48 | 30 |

experiment 1; compound d

| days | -% tra | -% re | red | green | blue | days | -% tra | -% re | red | green | blue |
|---|---|---|---|---|---|---|---|---|---|---|---|
| 0 | | | 150 | 34 | 23 | 0 | | | 150 | 34 | 23 |
| 3 | 0 | 0 | 150 | 36 | 23 | 7 | 1 | +2 | 150 | 35 | 23 |
| 6 | 1 | 1 | 150 | 36 | 23 | 14 | 1 | +2 | 150 | 37 | 24 |
| 9 | 1 | 2 | 150 | 37 | 24 | 21 | 1 | +2 | 150 | 37 | 24 |
| 12 | 1 | 4 | 150 | 37 | 24 | 28 | 3 | +2 | 150 | 37 | 24 |

experiment 1; compound e

| days | -% tra | -% re | red | green | blue | days | -% tra | -% re | red | green | blue |
|---|---|---|---|---|---|---|---|---|---|---|---|
| 0 | | | 150 | 35 | 23 | 0 | | | 150 | 36 | 23 |
| 3 | 0 | 5 | 150 | 37 | 24 | 7 | 3 | 4 | 150 | 37 | 24 |
| 6 | 0 | 5 | 150 | 38 | 24 | 14 | 3 | 5 | 150 | 39 | 24 |
| 9 | 1 | 11 | 150 | 39 | 24 | 21 | 4 | 4 | 150 | 40 | 24 |
| 12 | 2 | 11 | 150 | 40 | 26 | 28 | 5 | 4 | 150 | 41 | 25 |

experiment 1; compound f

| days | -% tra | -% re | red | green | blue | days | -% tra | -% re | red | green | blue |
|---|---|---|---|---|---|---|---|---|---|---|---|
| 0 | | | 150 | 38 | 24 | 0 | | | 150 | 37 | 23 |
| 3 | 4 | 2 | 150 | 40 | 26 | 7 | 3 | 3 | 150 | 40 | 25 |
| 6 | 3 | 2 | 150 | 41 | 26 | 14 | 2 | 3 | 150 | 41 | 26 |
| 9 | 3 | 2 | 150 | 42 | 27 | 21 | 3 | 3 | 150 | 41 | 26 |
| 12 | 6 | 3 | 150 | 43 | 27 | 28 | 3 | 3 | 150 | 42 | 26 |

experiment 1; compound g

| days | -% tra | -% re | red | green | blue | days | -% tra | -% re | red | green | blue |
|---|---|---|---|---|---|---|---|---|---|---|---|
| 0 | | | 150 | 35 | 23 | 0 | | | 150 | 35 | 23 |
| 3 | 2 | +5 | 150 | 38 | 25 | 7 | 1 | 0 | 150 | 39 | 25 |
| 6 | 2 | +1 | 150 | 39 | 25 | 14 | 2 | 0 | 150 | 40 | 25 |
| 9 | 3 | +2 | 150 | 40 | 25 | 21 | 3 | 0 | 150 | 41 | 26 |
| 12 | 3 | +1 | 150 | 41 | 26 | 28 | 3 | 0 | 150 | 42 | 26 |

experiment 1; compound h

| days | -% tra | -% re | red | green | blue | days | -% tra | -% re | red | green | blue |
|---|---|---|---|---|---|---|---|---|---|---|---|
| 0 | | | 150 | 35 | 23 | 0 | | | 150 | 35 | 23 |
| 3 | 0 | 1 | 150 | 36 | 24 | 7 | 7 | 0 | 150 | 37 | 23 |
| 6 | 1 | 1 | 150 | 36 | 23 | 14 | 8 | 1 | 150 | 38 | 23 |
| 9 | 2 | 0 | 150 | 36 | 24 | 21 | 9 | 4 | 150 | 39 | 24 |
| 12 | 2 | 0 | 150 | 37 | 24 | 28 | 10 | 3 | 150 | 41 | 24 |

experiment 1; compound i

| days | -% tra | -% re | red | green | blue | days | -% tra | -% re | red | green | blue |
|---|---|---|---|---|---|---|---|---|---|---|---|
| 0 | | | 150 | 35 | 23 | 0 | | | 150 | 35 | 23 |
| 3 | 0 | 0 | 150 | 36 | 24 | 7 | 0 | 3 | 150 | 37 | 23 |
| 6 | 1 | +1 | 150 | 36 | 23 | 14 | 2 | 9 | 150 | 38 | 23 |
| 9 | 2 | +1 | 150 | 37 | 24 | 21 | 3 | 7 | 150 | 39 | 24 |
| 12 | 2 | +1 | 150 | 37 | 24 | 28 | 4 | 7 | 150 | 40 | 24 |

experiment 1; compound j

| days | -% tra | -% re | red | green | blue | days | -% tra | -% re | red | green | blue |
|---|---|---|---|---|---|---|---|---|---|---|---|
| 0 | | | 150 | 35 | 23 | 0 | | | 150 | 35 | 23 |
| 3 | 1 | 2 | 150 | 37 | 24 | 7 | 2 | 0 | 150 | 38 | 24 |
| 6 | 2 | 4 | 150 | 39 | 25 | 14 | 2 | 0 | 150 | 41 | 25 |
| 9 | 3 | 4 | 150 | 40 | 25 | 21 | 4 | 0 | 150 | 42 | 26 |
| 12 | 4 | 4 | 150 | 41 | 27 | 28 | 5 | 0 | 150 | 43 | 26 |

experiment 1; compound l

| days | -% tra | -% re | red | green | blue | days | -% tra | -% re | red | green | blue |
|---|---|---|---|---|---|---|---|---|---|---|---|
| 0 | | | 150 | 35 | 23 | 0 | | | 150 | 34 | 23 |
| 3 | 2 | 0 | 150 | 36 | 24 | 7 | 0 | 1 | 150 | 35 | 23 |
| 6 | 1 | 0 | 150 | 36 | 24 | 14 | 2 | 4 | 150 | 36 | 24 |
| 9 | 2 | 2 | 150 | 37 | 24 | 21 | 2 | 5 | 150 | 37 | 24 |
| 12 | 2 | 3 | 150 | 38 | 25 | 28 | 3 | 4 | 150 | 37 | 24 |

experiment 1; compound m

| days | -% tra | -% re | red | green | blue | days | -% tra | -% re | red | green | blue |
|---|---|---|---|---|---|---|---|---|---|---|---|
| 0 | | | 150 | 36 | 23 | 0 | | | 150 | 36 | 23 |
| 3 | 3 | 1 | 150 | 40 | 25 | 7 | 2 | 0 | 150 | 39 | 24 |
| 6 | 4 | 2 | 150 | 41 | 25 | 14 | 4 | 2 | 150 | 44 | 26 |
| 9 | 6 | 2 | 150 | 43 | 26 | 21 | 5 | 2 | 150 | 46 | 26 |
| 12 | 7 | 3 | 150 | 45 | 27 | 28 | 7 | 2 | 150 | 47 | 27 |

experiment 1; compound n

| days | -%tra | -%re | red | green | blue | days | -%tra | -%re | red | green | blue |
|---|---|---|---|---|---|---|---|---|---|---|---|
| 0 | | | 150 | 36 | 23 | 0 | | | 150 | 35 | 23 |
| 3 | 2 | +1 | 150 | 39 | 24 | 7 | 2 | 0 | 150 | 39 | 24 |
| 6 | 4 | 0 | 150 | 41 | 25 | 14 | 4 | 1 | 150 | 43 | 26 |
| 9 | 5 | 4 | 150 | 42 | 25 | 21 | 5 | 5 | 150 | 44 | 26 |
| 12 | 5 | 5 | 150 | 43 | 26 | 28 | 6 | 5 | 150 | 45 | 26 |

experiment 1; compound o

| days | -%tra | -%re | red | green | blue | days | -%tra | -%re | red | green | blue |
|---|---|---|---|---|---|---|---|---|---|---|---|
| 0 | | | 150 | 36 | 23 | 0 | | | 150 | 36 | 23 |
| 3 | 2 | 4 | 150 | 40 | 25 | 7 | 0 | 0 | 150 | 40 | 25 |
| 6 | 3 | 4 | 150 | 42 | 26 | 14 | 3 | 3 | 150 | 45 | 27 |
| 9 | 4 | 4 | 150 | 44 | 26 | 21 | 5 | 6 | 150 | 47 | 27 |
| 12 | 4 | 4 | 150 | 45 | 28 | 28 | 7 | 8 | 150 | 48 | 27 |

experiment 1; compound p

| days | -%tra | -%re | red | green | blue | days | -%tra | -%re | red | green | blue |
|---|---|---|---|---|---|---|---|---|---|---|---|
| 0 | | | 150 | 31 | 22 | 0 | | | 150 | 32 | 23 |
| 3 | +11 | +3 | 150 | 35 | 24 | 7 | +1 | 6 | 150 | 35 | 24 |
| 6 | +10 | +3 | 150 | 36 | 25 | 14 | +2 | 5 | 150 | 37 | 25 |
| 9 | +10 | +3 | 150 | 37 | 25 | 21 | +2 | 3 | 150 | 38 | 25 |
| 12 | +10 | 1 | 150 | 38 | 25 | 28 | +2 | 1 | 150 | 39 | 26 |

experiment 1; compound q

| days | -%tra | -%re | red | green | blue | days | -%tra | -%re | red | green | blue |
|---|---|---|---|---|---|---|---|---|---|---|---|
| 0 | | | 150 | 35 | 25 | 0 | | | 150 | 33 | 24 |
| 3 | +4 | 2 | 150 | 34 | 25 | 7 | +5 | 6 | 150 | 33 | 24 |
| 6 | +4 | 3 | 150 | 34 | 26 | 14 | +6 | 6 | 150 | 34 | 25 |
| 9 | +4 | 6 | 150 | 35 | 27 | 21 | +7 | 9 | 150 | 34 | 25 |
| 12 | +5 | 7 | 150 | 35 | 26 | 28 | +7 | 10 | 150 | 35 | 25 |

experiment l; compound g + compound h

| days | -%tra | -%re | red | green | blue | days | -%tra | -%re | red | green | blue |
|---|---|---|---|---|---|---|---|---|---|---|---|
| 0 | | | 150 | 35 | 22 | 0 | | | 150 | 34 | 22 |
| 3 | 1 | 0 | 150 | 36 | 23 | 7 | 0 | 1 | 150 | 36 | 23 |
| 6 | 2 | 1 | 150 | 37 | 23 | 14 | 0 | 2 | 150 | 37 | 23 |
| 9 | 1 | 1 | 150 | 37 | 23 | 21 | 0 | 1 | 150 | 38 | 24 |
| 12 | 2 | 1 | 150 | 38 | 23 | 28 | 2 | 0 | 150 | 39 | 24 |

experiment 2; comparison without compound A-X

| days | -%tra | -%re | red | green | blue | days | -%tra | -%re | red | green | blue |
|---|---|---|---|---|---|---|---|---|---|---|---|
| 0 | | | 150 | 42 | 23 | 0 | | | 150 | 42 | 23 |
| 3 | 4 | 2 | 150 | 49 | 28 | 7 | 3 | 1 | 150 | 47 | 27 |
| 6 | 7 | 4 | 150 | 50 | 29 | 14 | 9 | 4 | 150 | 53 | 30 |
| 9 | 8 | 4 | 150 | 53 | 30 | 21 | 10 | 7 | 150 | 54 | 31 |
| 12 | 9 | 4 | 150 | 54 | 31 | 28 | 12 | 8 | 150 | 54 | 31 |

experiment 2; compound a

| days | -%tra | -%re | red | green | blue | days | -%tra | -%re | red | green | blue |
|---|---|---|---|---|---|---|---|---|---|---|---|
| 0 | | | 150 | 44 | 23 | 0 | | | 150 | 42 | 22 |
| 3 | 2 | 5 | 150 | 45 | 26 | 7 | 0 | 4 | 150 | 42 | 23 |
| 6 | 4 | 6 | 150 | 46 | 26 | 14 | 1 | 9 | 150 | 43 | 23 |
| 9 | 6 | 6 | 150 | 46 | 26 | 21 | 1 | 11 | 150 | 43 | 23 |
| 12 | 9 | 6 | 150 | 46 | 26 | 28 | 1 | 13 | 150 | 44 | 24 |

experiment 2; compound d

| days | -%tra | -%re | red | green | blue | days | -%tra | -%re | red | green | blue |
|---|---|---|---|---|---|---|---|---|---|---|---|
| 0 | | | 150 | 41 | 22 | 0 | | | 150 | 41 | 22 |
| 3 | 1 | 2 | 150 | 41 | 22 | 7 | 0 | +2 | 150 | 41 | 22 |
| 6 | 0 | 2 | 150 | 41 | 23 | 14 | 1 | +5 | 150 | 42 | 23 |
| 9 | 1 | 9 | 150 | 42 | 23 | 21 | 1 | +5 | 150 | 42 | 23 |
| 12 | 3 | 11 | 150 | 43 | 24 | 28 | 2 | +4 | 150 | 42 | 23 |

experiment 2; compound e

| days | -%tra | -%re | red | green | blue | days | -%tra | -%re | red | green | blue |
|---|---|---|---|---|---|---|---|---|---|---|---|
| 0 | | | 150 | 42 | 22 | 0 | | | 150 | 41 | 22 |
| 3 | 0 | 0 | 150 | 43 | 23 | 7 | 1 | 0 | 150 | 42 | 23 |
| 6 | 0 | 2 | 150 | 43 | 24 | 14 | 7 | 12 | 150 | 45 | 24 |
| 9 | 3 | 3 | 150 | 45 | 24 | 21 | 7 | 15 | 150 | 45 | 24 |
| 12 | 3 | 4 | 150 | 46 | 25 | 28 | 9 | 16 | 150 | 46 | 25 |

experiment 2; compound g

| days | -%tra | -%re | red | green | blue | days | -%tra | -%re | red | green | blue |
|---|---|---|---|---|---|---|---|---|---|---|---|
| 0 | | | 150 | 42 | 23 | 0 | | | 150 | 40 | 22 |
| 3 | 2 | 9 | 150 | 43 | 25 | 7 | 1 | +2 | 150 | 42 | 23 |
| 6 | 3 | 7 | 150 | 44 | 25 | 14 | 3 | 4 | 150 | 45 | 25 |
| 9 | 7 | 6 | 150 | 45 | 26 | 21 | 4 | 1 | 150 | 44 | 25 |
| 12 | 7 | 5 | 150 | 45 | 27 | 28 | 4 | 4 | 150 | 45 | 25 |

experiment 2; compound h

| days | -%tra | -%re | red | green | blue | days | -%tra | -%re | red | green | blue |
|---|---|---|---|---|---|---|---|---|---|---|---|
| 0 | | | 150 | 43 | 23 | 0 | | | 150 | 41 | 22 |
| 3 | 0 | +7 | 150 | 42 | 23 | 7 | 0 | 7 | 150 | 42 | 23 |
| 6 | 0 | +8 | 150 | 42 | 24 | 14 | 1 | 10 | 150 | 42 | 23 |
| 9 | 0 | +8 | 150 | 42 | 25 | 21 | 1 | 12 | 150 | 43 | 23 |
| 12 | 0 | +7 | 150 | 42 | 27 | 28 | 2 | 14 | 150 | 43 | 23 |

experiment 2; compound i

| days | -%tra | -%re | red | green | blue | days | -%tra | -%re | red | green | blue |
|---|---|---|---|---|---|---|---|---|---|---|---|
| 0 | | | 150 | 43 | 23 | 0 | | | 150 | 41 | 22 |
| 3 | 1 | +11 | 150 | 42 | 23 | 7 | 0 | +2 | 150 | 42 | 22 |
| 6 | 0 | +11 | 150 | 42 | 24 | 14 | 0 | +1 | 150 | 42 | 23 |
| 9 | 0 | +12 | 150 | 41 | 24 | 21 | 1 | 1 | 150 | 43 | 23 |
| 12 | 0 | +12 | 150 | 42 | 24 | 28 | 2 | 5 | 150 | 43 | 23 |

experiment 2; compound n

| days | -%tra | -%re | red | green | blue | days | -%tra | -%re | red | green | blue |
|---|---|---|---|---|---|---|---|---|---|---|---|
| 0 | | | 150 | 41 | 23 | 0 | | | 150 | 41 | 22 |
| 3 | 2 | 4 | 150 | 42 | 23 | 7 | 1 | +1 | 150 | 43 | 23 |
| 6 | 4 | 6 | 150 | 43 | 23 | 14 | 3 | +1 | 150 | 45 | 24 |
| 9 | 6 | 11 | 150 | 44 | 24 | 21 | 3 | 1 | 150 | 45 | 24 |
| 12 | 6 | 12 | 150 | 45 | 24 | 28 | 5 | 2 | 150 | 46 | 25 |

experiment 2; compound g + compound h

| days | -%tra | -%re | red | green | blue | days | -%tra | -%re | red | green | blue |
|---|---|---|---|---|---|---|---|---|---|---|---|
| 0 | | | 150 | 40 | 22 | 0 | | | 150 | 42 | 22 |
| 3 | +4 | 0 | 150 | 40 | 22 | 7 | +2 | 2 | 150 | 42 | 23 |
| 6 | +1 | 4 | 150 | 41 | 22 | 14 | 0 | 7 | 150 | 42 | 23 |
| 9 | 0 | 5 | 150 | 41 | 22 | 21 | 0 | 10 | 150 | 43 | 24 |
| 12 | 0 | 8 | 150 | 41 | 24 | 28 | 0 | 11 | 150 | 43 | 24 |

experiment 3; comparison without compound A-X

| days | -%tra | -%re | red | green | blue | days | -%tra | -%re | red | green | blue |
|---|---|---|---|---|---|---|---|---|---|---|---|
| 0 | | | 8 | 13 | 150 | 0 | | | 8 | 13 | 150 |
| 3 | 11 | 10 | 12 | 16 | 150 | 7 | 8 | 7 | 10 | 15 | 150 |
| 6 | 17 | 15 | 12 | 17 | 150 | 14 | 21 | 19 | 13 | 18 | 150 |
| 9 | 24 | 20 | 13 | 18 | 150 | 21 | 23 | 21 | 13 | 18 | 150 |
| 12 | 24 | 23 | 14 | 19 | 150 | 28 | 24 | 23 | 13 | 18 | 150 |

experiment 3; compound b

| days | -%tra | -%re | red | green | blue | days | -%tra | -%re | red | green | blue |
|---|---|---|---|---|---|---|---|---|---|---|---|
| 0 | | | 7 | 13 | 150 | 0 | | | 7 | 13 | 150 |
| 3 | 0 | 6 | 8 | 14 | 150 | 7 | 0 | 4 | 8 | 14 | 150 |
| 6 | 0 | 6 | 8 | 14 | 150 | 14 | 12 | 16 | 8 | 14 | 150 |
| 9 | 0 | 11 | 8 | 14 | 150 | 21 | 12 | 17 | 8 | 14 | 150 |
| 12 | 4 | 12 | 8 | 14 | 150 | 28 | 12 | 17 | 8 | 14 | 150 |

experiment 3; compound d

| days | -%tra | -%re | red | green | blue | days | -%tra | -%re | red | green | blue |
|---|---|---|---|---|---|---|---|---|---|---|---|
| 0 | | | 7 | 13 | 150 | 0 | | | 8 | 13 | 150 |
| 3 | 5 | 0 | 8 | 13 | 150 | 7 | 2 | 0 | 8 | 13 | 150 |
| 6 | 5 | 2 | 8 | 13 | 150 | 14 | 4 | 7 | 8 | 13 | 150 |
| 9 | 8 | 4 | 8 | 13 | 150 | 21 | 9 | 8 | 8 | 13 | 150 |
| 12 | 9 | 7 | 8 | 13 | 150 | 28 | 11 | 8 | 8 | 13 | 150 |

experiment 3; compound e

| days | -%tra | -%re | red | green | blue | days | -%tra | -%re | red | green | blue |
|---|---|---|---|---|---|---|---|---|---|---|---|
| 0 | | | 8 | 13 | 150 | 0 | | | 8 | 13 | 150 |
| 3 | 10 | 10 | 8 | 13 | 150 | 7 | 3 | 6 | 8 | 13 | 150 |
| 6 | 15 | 13 | 8 | 13 | 150 | 14 | 14 | 17 | 8 | 13 | 150 |
| 9 | 18 | 16 | 9 | 14 | 150 | 21 | 17 | 19 | 8 | 13 | 150 |
| 12 | 21 | 28 | 9 | 14 | 150 | 28 | 20 | 20 | 9 | 14 | 150 |

experiment 3; compound g

| days | -% tra | -% re | red | green | blue | days | -% tra | -% re | red | green | blue |
|---|---|---|---|---|---|---|---|---|---|---|---|
| 0 | | | 7 | 12 | 150 | 0 | | | 8 | 12 | 150 |
| 3 | 9 | +6 | 11 | 15 | 150 | 7 | 5 | 0 | 9 | 14 | 150 |
| 6 | 10 | +3 | 11 | 15 | 150 | 14 | 9 | 3 | 9 | 14 | 150 |
| 9 | 15 | 0 | 11 | 15 | 150 | 21 | 9 | 4 | 9 | 14 | 150 |
| 12 | 18 | 2 | 13 | 16 | 150 | 28 | 12 | 6 | 10 | 14 | 150 |

experiment 3; compound h

| days | -% tra | -% re | red | green | blue | days | -% tra | -% re | red | green | blue |
|---|---|---|---|---|---|---|---|---|---|---|---|
| 0 | | | 8 | 13 | 150 | 0 | | | 8 | 13 | 150 |
| 3 | 5 | 3 | 8 | 13 | 150 | 7 | 2 | 6 | 8 | 13 | 150 |
| 6 | 7 | 6 | 8 | 13 | 150 | 14 | 3 | 7 | 8 | 13 | 150 |
| 9 | 8 | 8 | 8 | 13 | 150 | 21 | 3 | 7 | 8 | 12 | 150 |
| 12 | 11 | 9 | 8 | 13 | 150 | 28 | 3 | 8 | 8 | 13 | 150 |

experiment 3; compound p

| days | -% tra | -% re | red | green | blue | days | -% tra | -% re | red | green | blue |
|---|---|---|---|---|---|---|---|---|---|---|---|
| 0 | | | 8 | 13 | 150 | 0 | | | 7 | 13 | 150 |
| 3 | 7 | 3 | 9 | 14 | 150 | 7 | 15 | +5 | 8 | 13 | 150 |
| 6 | 12 | 11 | 9 | 14 | 150 | 14 | 16 | +3 | 8 | 14 | 150 |
| 9 | 15 | 14 | 10 | 15 | 150 | 21 | 18 | 0 | 9 | 14 | 150 |
| 12 | 20 | 19 | 9 | 15 | 150 | 28 | 18 | 0 | 9 | 14 | 150 |

experiment 3; compound q

| days | -% tra | -% re | red | green | blue | days | -% tra | -% re | red | green | blue |
|---|---|---|---|---|---|---|---|---|---|---|---|
| 0 | | | 8 | 13 | 150 | 0 | | | 8 | 12 | 150 |
| 3 | 1 | +10 | 9 | 13 | 150 | 7 | +8 | +15 | 8 | 13 | 150 |
| 6 | 4 | +8 | 8 | 13 | 150 | 14 | +8 | +11 | 8 | 13 | 150 |
| 9 | 5 | +5 | 9 | 14 | 150 | 21 | +8 | +10 | 9 | 13 | 150 |
| 12 | 10 | +3 | 8 | 14 | 150 | 28 | +6 | +10 | 9 | 13 | 150 |

experiment 3; compound g + compound h

| days | -% tra | -% re | red | green | blue | days | -% tra | -% re | red | green | blue |
|---|---|---|---|---|---|---|---|---|---|---|---|
| 0 | | | 8 | 13 | 150 | 0 | | | 8 | 12 | 150 |
| 3 | 5 | 6 | 8 | 13 | 150 | 7 | 1 | 5 | 8 | 13 | 150 |
| 6 | 10 | 7 | 8 | 13 | 150 | 14 | 1 | 7 | 8 | 13 | 150 |
| 9 | 10 | 10 | 8 | 13 | 150 | 21 | 6 | 10 | 8 | 13 | 150 |
| 12 | 14 | 10 | 8 | 13 | 150 | 28 | 8 | 11 | 9 | 13 | 150 |

experiment 4; comparison without compound A-X

| days | -% tra | -% re | red | green | blue | days | -% tra | -% re | red | green | blue |
|---|---|---|---|---|---|---|---|---|---|---|---|
| 0 | | | 18 | 150 | 46 | 0 | | | 18 | 150 | 44 |
| 3 | 5 | +3 | 17 | 150 | 48 | 7 | 9 | 6 | 16 | 150 | 52 |
| 6 | 7 | +3 | 16 | 150 | 50 | 14 | 9 | 2 | 17 | 150 | 52 |
| 9 | 8 | +2 | 16 | 150 | 51 | 21 | 10 | 0 | 16 | 150 | 51 |
| 12 | 12 | +1 | 16 | 150 | 53 | 28 | 10 | 0 | 16 | 150 | 52 |

experiment 4; compound d

| days | -% tra | -% re | red | green | blue | days | -% tra | -% re | red | green | blue |
|---|---|---|---|---|---|---|---|---|---|---|---|
| 0 | | | 23 | 150 | 43 | 0 | | | 24 | 150 | 43 |
| 3 | 2 | 4 | 22 | 150 | 43 | 7 | 5 | +2 | 22 | 150 | 43 |
| 6 | 4 | 3 | 22 | 150 | 44 | 14 | 5 | +2 | 23 | 150 | 44 |
| 9 | 7 | 2 | 22 | 150 | 44 | 21 | 4 | +2 | 23 | 150 | 44 |
| 12 | 9 | 2 | 22 | 150 | 44 | 28 | 5 | +2 | 23 | 150 | 44 |

experiment 4; compound a

| days | -% tra | -% re | red | green | blue | days | -% tra | -% re | red | green | blue |
|---|---|---|---|---|---|---|---|---|---|---|---|
| 0 | | | 19 | 150 | 41 | 0 | | | 19 | 150 | 41 |
| 3 | 0 | 0 | 19 | 150 | 43 | 7 | 1 | 0 | 17 | 150 | 43 |
| 6 | 3 | 0 | 17 | 150 | 44 | 14 | 1 | 0 | 17 | 150 | 43 |
| 9 | 5 | 0 | 17 | 150 | 45 | 21 | 1 | 0 | 17 | 150 | 44 |
| 12 | 6 | 2 | 17 | 150 | 44 | 28 | 1 | 0 | 17 | 150 | 44 |

experiment 5; comparison without compound A-X

| days | -% tra | -% re | red | green | blue | days | -% tra | -% re | red | green | blue |
|---|---|---|---|---|---|---|---|---|---|---|---|
| 0 | | | 150 | 40 | 25 | 0 | | | 150 | 38 | 23 |
| 3 | 6 | +3 | 150 | 45 | 28 | 7 | 5 | 7 | 150 | 43 | 27 |
| 6 | 7 | 1 | 150 | 47 | 29 | 14 | 5 | 8 | 150 | 44 | 28 |
| 9 | 10 | +1 | 150 | 51 | 32 | 21 | 4 | 8 | 150 | 45 | 28 |
| 12 | 11 | +2 | 150 | 51 | 32 | 28 | 6 | 8 | 150 | 45 | 28 |

experiment 5; compound p

| days | -% tra | -% re | red | green | blue | days | -% tra | -% re | red | green | blue |
|---|---|---|---|---|---|---|---|---|---|---|---|
| 0 | | | 150 | 35 | 21 | 0 | | | 150 | 35 | 21 |
| 3 | 2 | 2 | 150 | 38 | 23 | 7 | 0 | 5 | 150 | 37 | 23 |
| 6 | 2 | 4 | 150 | 39 | 24 | 14 | 1 | 5 | 150 | 37 | 23 |
| 9 | 4 | 7 | 150 | 39 | 24 | 21 | 2 | 2 | 150 | 38 | 23 |
| 12 | 9 | 7 | 150 | 41 | 25 | 28 | 2 | 3 | 150 | 39 | 24 |

experiment 5; compound q

| days | -% tra | -% re | red | green | blue | days | -% tra | -% re | red | green | blue |
|---|---|---|---|---|---|---|---|---|---|---|---|
| 0 | | | 150 | 38 | 20 | 0 | | | 150 | 38 | 20 |
| 3 | 0 | +22 | 150 | 39 | 22 | 7 | 4 | +8 | 150 | 36 | 22 |
| 6 | +1 | +32 | 150 | 38 | 23 | 14 | 4 | +4 | 150 | 36 | 22 |
| 9 | 0 | +31 | 150 | 40 | 24 | 21 | 6 | +4 | 150 | 36 | 22 |
| 12 | 0 | +32 | 150 | 40 | 24 | 28 | 6 | +18 | 150 | 37 | 22 |

experiment 5; compound r

| days | -% tra | -% re | red | green | blue | days | -% tra | -% re | red | green | blue |
|---|---|---|---|---|---|---|---|---|---|---|---|
| 0 | | | 150 | 36 | 22 | 0 | | | 150 | 36 | 22 |
| 3 | 1 | +6 | 150 | 37 | 22 | 7 | 0 | 5 | 150 | 36 | 22 |
| 6 | 3 | +6 | 150 | 38 | 22 | 14 | 1 | 5 | 150 | 36 | 22 |
| 9 | 2 | +5 | 150 | 38 | 22 | 21 | 1 | 4 | 150 | 36 | 22 |
| 12 | 2 | +5 | 150 | 38 | 22 | 28 | 1 | 7 | 150 | 36 | 22 |

experiment 5; compound s

| days | -% tra | -% re | red | green | blue | days | -% tra | -% re | red | green | blue |
|---|---|---|---|---|---|---|---|---|---|---|---|
| 0 | | | 150 | 38 | 23 | 0 | | | 150 | 35 | 22 |
| 3 | 1 | 0 | 150 | 37 | 22 | 7 | 2 | 1 | 150 | 36 | 22 |
| 6 | 2 | 1 | 150 | 38 | 23 | 14 | 1 | 2 | 150 | 36 | 22 |
| 9 | 3 | 2 | 150 | 37 | 22 | 21 | 1 | 1 | 150 | 36 | 22 |
| 12 | 3 | 2 | 150 | 38 | 22 | 28 | 2 | 0 | 150 | 36 | 22 |

experiment 5; compound t

| days | -% tra | -% re | red | green | blue | days | -% tra | -% re | red | green | blue |
|---|---|---|---|---|---|---|---|---|---|---|---|
| 0 | | | 150 | 39 | 23 | 0 | | | 150 | 36 | 22 |
| 3 | 2 | +16 | 150 | 38 | 23 | 7 | 0 | +3 | 150 | 38 | 23 |
| 6 | 2 | +9 | 150 | 39 | 23 | 14 | 1 | +3 | 150 | 38 | 23 |
| 9 | 4 | +9 | 150 | 39 | 23 | 21 | 1 | +5 | 150 | 38 | 22 |
| 12 | 4 | +11 | 150 | 39 | 23 | 28 | 0 | +5 | 150 | 37 | 22 |

| experiment 5; compound u | | | | | | | | | | | |
|---|---|---|---|---|---|---|---|---|---|---|---|
| days | -% tra | -% re | red | green | blue | days | -% tra | -% re | red | green | blue |
| 0 | | | 150 | 35 | 22 | 0 | | | 150 | 38 | 23 |
| 3 | 1 | +6 | 150 | 36 | 22 | 7 | 2 | 5 | 150 | 38 | 23 |
| 6 | 2 | +3 | 150 | 37 | 22 | 14 | 2 | 5 | 150 | 38 | 23 |
| 9 | 3 | +3 | 150 | 37 | 22 | 21 | 2 | 5 | 150 | 38 | 23 |
| 12 | 3 | +5 | 150 | 37 | 22 | 28 | 2 | 3 | 150 | 38 | 23 |

| experiment 5; compound v | | | | | | | | | | | |
|---|---|---|---|---|---|---|---|---|---|---|---|
| days | -% tra | -% re | red | green | blue | days | -% tra | -% re | red | green | blue |
| 0 | | | 150 | 39 | 23 | 0 | | | 150 | 40 | 24 |
| 3 | 2 | +11 | 150 | 38 | 22 | 7 | 2 | 1 | 150 | 38 | 23 |
| 6 | 3 | +11 | 150 | 38 | 23 | 14 | 2 | 0 | 150 | 39 | 24 |
| 9 | 4 | +10 | 150 | 38 | 22 | 21 | 2 | +2 | 150 | 40 | 24 |
| 12 | 5 | +9 | 150 | 38 | 23 | 28 | 2 | +3 | 150 | 39 | 23 |

| experiment 5; compound w | | | | | | | | | | | |
|---|---|---|---|---|---|---|---|---|---|---|---|
| days | -% tra | -% re | red | green | blue | days | -% tra | -% re | red | green | blue |
| 0 | | | 150 | 37 | 22 | 0 | | | 150 | 38 | 23 |
| 3 | 1 | +10 | 150 | 36 | 21 | 7 | +1 | +2 | 150 | 38 | 23 |
| 6 | 2 | +11 | 150 | 37 | 22 | 14 | +1 | +4 | 150 | 38 | 23 |
| 9 | 3 | +10 | 150 | 37 | 22 | 21 | +1 | +7 | 150 | 38 | 23 |
| 12 | 4 | +9 | 150 | 38 | 22 | 28 | +1 | +9 | 150 | 38 | 22 |

| experiment 5; compound x | | | | | | | | | | | |
|---|---|---|---|---|---|---|---|---|---|---|---|
| days | -% tra | -% re | red | green | blue | days | -% tra | -% re | red | green | blue |
| 0 | | | 150 | 37 | 23 | 0 | | | 150 | 35 | 22 |
| 3 | 0 | +6 | 150 | 37 | 22 | 7 | 3 | 2 | 150 | 36 | 22 |
| 6 | 0 | +4 | 150 | 38 | 22 | 14 | 3 | 5 | 150 | 36 | 22 |
| 9 | 1 | +4 | 150 | 37 | 22 | 21 | 4 | 2 | 150 | 36 | 22 |
| 12 | 2 | +5 | 150 | 37 | 22 | 28 | 4 | 3 | 150 | 36 | 22 |

| experiment 5; compound y | | | | | | | | | | | |
|---|---|---|---|---|---|---|---|---|---|---|---|
| days | -% tra | -% re | red | green | blue | days | -% tra | -% re | red | green | blue |
| 0 | | | 150 | 36 | 22 | 0 | | | 150 | 36 | 23 |
| 3 | 0 | 0 | 150 | 36 | 22 | 7 | 4 | 3 | 150 | 37 | 24 |
| 6 | 1 | 2 | 150 | 36 | 23 | 14 | 5 | 6 | 150 | 37 | 24 |
| 9 | 2 | 6 | 150 | 37 | 23 | 21 | 5 | 4 | 150 | 37 | 24 |
| 12 | 3 | 7 | 150 | 38 | 23 | 28 | 5 | 6 | 150 | 37 | 24 |

The experimental results given above clearly show the favourable stabilizing effect of the inventive compounds A-X on the dye which has been thermally transferred.

EXAMPLE 2

This example illustrates the stabilizing effect of a monomeric as well as of a polymeric compound A-X, which has been included in the receiving element, on the dye which has been thermally transferred to said element.

A dye-donor element for use according to thermal dye transfer was prepared as described in Example 1. The dye used was the cyan dye of experiment 2. However, no compound A-X was incorporated in the dye-containing layer.

The dye-donor element thus prepared was printed in combination with a receiving element as described below in a Hitachi colour video printer VY-100A.

The receiving element was separated from the dye-donor element and stored at a temperature of 57° C. and a relative humidity of 34% for some days as set forth below. Then the values mentioned in Example 1 were determined as described therein.

The receiving element was prepared by applying to a sheet of polyethylene-coated paper of 140 g/m$^2$ a dye receiving layer and applying thereto a releasing agent. This releasing agent was applied from a solution of TEGOGLIDE 410 in 996 ml ethanol, which was coated in such a manner that 100 mg/m$^2$ TEGOGLIDE was present.

Thus three receiving elements were made, each time with another dye receiving layer.

The first dye receiving layer was formed from a solution of 54 g SOLVIC 560 RA (trade mark of Solvay of an 88/12 copolymer of vinyl chloride and vinyl acetate) in 946 ml ethyl methyl ketone, so that 3.6 g SOLVIC/m$^2$ was present (receiving element 1; comparison without a compound A-X).

The second dye receiving layer was formed from a solution of 54 g SOLVIC and 13.5 g of compound a in 932 ml ethyl methyl ketone, so that 0.9 g/m$^2$ of compound a was present (receiving element 2; containing a monomeric compound A-X).

The third dye receiving layer was formed from a solution of 54 g SOLVIC and 13.5 g of a copolymer of vinyl acetate, maleic anhydride and maleic acid (molar ratio 48/32/20; viscosity Hoeppler 20% in butanone at 25° C.: 7.5 m Pas) in 932 ml ethyl methyl ketone, so that 0.9 g of the latter copolymer/$m^2$ was present (receiving element 3; containing a polymeric compound A-X).

The results obtained are given below.

| receiving element 1; comparison without a compound A-X | | | | | |
|---|---|---|---|---|---|
| days | -% tra | -% re | red | green | blue |
| 0 | | | 150 | 44 | 20 |
| 3 | 8 | 5 | 150 | 42 | 19 |
| 6 | 8 | 5 | 150 | 47 | 22 |
| 9 | 9 | 5 | 150 | 47 | 22 |
| 12 | 12 | 9 | 150 | 53 | 27 |

| receiving element 2; containing a monomeric compound A-X | | | | | |
|---|---|---|---|---|---|
| days | -% tra | -% re | red | green | blue |
| 0 | | | 150 | 45 | 22 |
| 3 | 10 | 12 | 150 | 47 | 25 |
| 6 | 12 | 12 | 150 | 47 | 24 |
| 9 | 12 | 14 | 150 | 47 | 24 |
| 12 | 13 | 13 | 150 | 46 | 23 |

| receiving element 3; containing a polymeric compound A-X | | | | | |
|---|---|---|---|---|---|
| days | -% tra | -% re | red | green | blue |
| 0 | | | 150 | 48 | 22 |
| 3 | +2 | 0 | 150 | 50 | 23 |
| 6 | +6 | 0 | 150 | 50 | 24 |
| 9 | +7 | +2 | 150 | 49 | 22 |
| 12 | +9 | +2 | 150 | 49 | 23 |

The experimental results given above clearly show the favourable stabilizing effect of a monomeric and of a polymeric compound A-X, which has been included in the receiving element.

EXAMPLE 3

This example illustrates the stabilizing effect of an inventive compound A-X, which is initially present in a so-called black-dye-donor element, on the black dye which has been obtained in the receiving element after thermal transfer of three dyes from a single block of a dye-donor element.

The dye-donor element was prepared as described in example 1, except that the dye-donor layer was coated from a solution of the following components in the given amounts in 10 ml of ethyl methyl ketone:

the yellow dye of experiment 3: 30 mg the cyan dye of experiment 1: 30 mg a magenta dye of the following formula: 20 mg

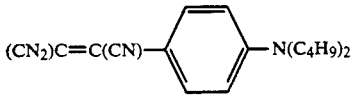

cellulose acetate butyrate of example 1: 50 mg compound h: 20 mg

A comparison was prepared in the same manner, but the compound A-X was omitted from the coating solution for producing the dye-donor layer.

The two dye-donor elements were printed in the same manner as described in example 1.

In both cases, a black print was produced in the receiving element.

On storage of the receiving elements under conditions of high temperature and relative humidity, it was found that the black print produced from the dye-donor element containing the inventive compound A-X excellently retained its initial black colour, whereas in the black print produced from the dye-donor element without the inventive compound A-X (comparison) the initial black colour becomes slightly greyish and also some colour hues become visible.

We claim:

1. Method of stabilizing a material for use in a thermal dye transfer diffusion process, by incorporating a compound satisfying the formula A-X wherein A stands for acyl, and X stands for the conjugated base of an acid with a pKa≦14, in a dye layer of a dye-donor element and/or in a receiving layer of a receiving element for use in carrying out said process.

2. Method according to claim 1, wherein A satisfies one of the formulae R—CO—, R—$SO_2$—, or $R_1R_2PO$— wherein:

R stands for substituted or unsubstituted alkyl, substituted or unsubstituted aralkyl, substituted or unsubstituted cycloalkyl, substituted or unsubstituted alkenyl, substituted or unsubstituted aryl, and $R_1$ and $R_2$ each independently represent substituted or unsubstituted alkyl, substituted or unsubstituted cycloalkyl, substituted or unsubstituted alkenyl, substituted or unsubstituted aralkyl, substituted or unsubstituted aryl, substituted or unsubstituted alkyloxy, substituted or unsubstituted aryloxy, substituted or unsubstituted alkylthio, substituted or unsubstituted amino or a substituted or unsubstituted heterocyclic group or $R_1$ and $R_2$ together represent the necessary atoms to close a 5- or 6-membered ring.

3. Method according to claim 1, wherein the compound A-X is a cyclic or acyclic anhydride or a mixed anhydride.

4. Method according to claim 3, wherein the compound A-X satisfies the following formula $R_3$—CO—O—CO—$R_4$ wherein $R_3$ and $R_4$ each independently represent substituted or unsubstituted alkyl, or substituted or unsubstituted aryl.

5. Method according to claim 3, wherein the compound A-X satisfies the following formula:

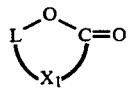

wherein L represents C=O or $SO_2$ and $X_1$ represents the atoms necessary to complete a saturated or unsaturated ring which may be substituted or not.

6. Method according to claim 5, wherein the compound A-X satisfies the following formula:

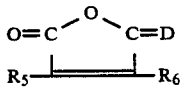

wherein $R_5$ and $R_6$ each independently represent hydrogen, halogen, substituted or unsubstituted alkyl, substituted or unsubstituted alkenyl, or substituted or unsubstituted aryl, or together represent the atoms necessary to close an aliphatic or aromatic carbocyclic or heterocyclic ring, which may contain further substituents.

7. Method according to claim 1, wherein the compound A-X satisfies the following formula $R_{13}SO_2Cl$ wherein $R_{13}$ is a cyclic or acyclic alkyl group, an aryl group or an aralkyl group which groups may be substituted.

8. Method according to claim 1, wherein the compound A-X satisfies the following formula:

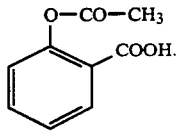

9. Method according to claim 1, wherein the compound A-X is initially present in the dye-donor element and co-transfers to the receiving element under the influence of heat.

10. Method according to claim 1, wherein the compound A-X as defined therein forms part of a polymer.

11. Method according to claim 10, wherein the compound A-X is at least one of the recurring units constituting the polymer.

12. Method according to claim 1, wherein the compound A-X is present in the dye-donor element in an amount of 10–1000 mg/m$^2$.

13. Method according to claim 1, wherein the compound A-X is present in the receiving element in an amount of 50–2000 mg/m$^2$.

14. Method according to claim 1, wherein the thermally transferable dye which is initially present in the dye-donor element is a dye which is susceptible to hydrolysis.

15. Method according to claim 14, wherein the thermally transferable dye contains at least one group selected from an amide group, an ester group, a sulfonamide group, a succinimide group and a carbamate group.

16. Method according to claim 15, wherein the thermally transferable dye corresponds to the formula:

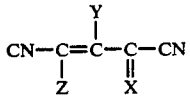

wherein

Z represents CN, $COOR^{21}$ or $CONR^{22}R^{23}$;

$R^{21}$, $R^{22}$ and $R^{23}$ each independently represent hydrogen, substituted or unsubstituted alkyl, substituted or unsubstituted cycloalkyl, substituted or unsubstituted aryl, or $R^{22}$ and $R^{23}$ together represent the necessary atoms to close a heterocyclic nucleus or substituted heterocyclic nucleus;

Y represents $OR^{24}$ or $NR^{25}R^{26}$ or CN;

$R^{24}$ represents hydrogen, substituted or unsubstituted alkyl, substituted or unsubstituted cycloalkyl, substituted or unsubstituted aryl, $SO_2R^{27}$, $COR^{27}$, $CSR^{27}$, $POR^{27}R^{28}$;

$R^{25}$ or $R^{26}$ each independently represent hydrogen, substituted or unsubstituted alkyl, substituted or unsubstituted cycloalkyl, substituted or unsubstituted aryl, $SO_2R^{27}$, $COR^{27}$, $CSR^{27}$, $POR^{27}R^{28}$ or represent substituted or unsubstituted amino, or $R^{25}$ and $R^{26}$ together represent the necessary atoms to close a heterocyclic nucleus or substituted heterocyclic nucleus, or a heterocyclic nucleus with an aliphatic or aromatic ring fused-on;

$R^{27}$ and $R^{28}$ each independently represent substituted or unsubstituted alkyl, substituted or unsubstituted cycloalkyl, substituted or unsubstituted alkenyl, substituted or unsubstituted aralkyl, substituted or unsubstituted aryl, substituted or unsubstituted alkyloxy, substituted or unsubstituted aryloxy, substituted or unsubstituted alkylthio, substituted or unsubstituted arylthio, substituted or unsubstituted amino, or a substituted or unsubstituted heterocyclic group or $R_{27}$ and $R_{28}$ together represent the necessary atoms to close a 5- or 6-membered ring, X represents N—Ar, N-Het, $CR^{29}R^{30}$, $N—NR^{31}R^{32}$ or $N—N{=}CR^{33}R^{34}$;

Ar represents an aromatic nucleus substituted in para position by a substituent chosen from the group consisting of substituted or unsubstituted amino, substituted or unsubstituted alkyloxy, substituted or unsubstituted aryloxy, substituted or unsubstituted alkylthio, substituted or unsubstituted arylthio, hydroxy, mercapto;

Het represents a substituted or unsubstituted heterocyclic ring;

$R^{29}$ and $R^{30}$ each independently represent hydrogen, substituted or unsubstituted alkyl, substituted or unsubstituted cycloalkyl, substituted or unsubstituted alkenyl, a substituted or unsubstituted heterocyclic group, cyano, halogen, $SO_2R_{27}$, $COR_{27}$, $CSR^{27}$, $POR^{27}R^{28}$, or $R^{29}$ and $R^{30}$ together represent the necessary atoms to close a substituted or unsubstituted ring or a substituted or unsubstituted heterocyclic ring;

$R^{31}$ represents a substituted or unsubstituted aromatic ring, including a substituted or unsubstituted aromatic heterocyclic ring;

$R^{32}$ represents hydrogen, substituted or unsubstituted alkyl, substituted or unsubstituted cycloalkyl, substituted or unsubstituted aryl, $SO_2R^{27}$, $COR^{27}$, $CSR^{27}$, $POR^{27}R^{28}$; and $R^{33}$ and $R^{34}$ each independently represent hydrogen, substituted or unsubstituted alkyl, substituted or unsubstituted cycloalkyl, substituted or unsubstituted aryl, or $R^{33}$ and $R^{34}$ together represent the necessary atoms to close a substituted or unsubstituted heterocyclic nucleus, or including a heterocyclic nucleus with an aliphatic or aromatic ring fused-on.

17. Dye-donor element for use in a thermal dye transfer diffusion process, said element comprising a support sheet which is coated at one side with a layer containing a binder and a thermally transferable dye, said dye layer additionally containing a compound A-X wherein A stands for acyl, and X stands for the conjugated base of an acid with a pKa$\leqq$14.

18. Dye-donor element according to claim 17, wherein said dye layer contains a thermally transferable dye which is susceptible to hydrolysis.

19. Dye-donor element according to claim 18, wherein said thermally transferable dye contains at least one group selected from an amide group, an ester group, a sulfonamide group, a succinimide group and a carbamate group.

20. Dye-donor element according to claim 19, wherein said thermally transferable dye corresponds to the formula:

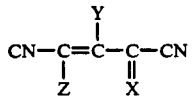

wherein

Z represents CN, $COOR^{21}$ or $CONR^{22}R^{23}$;

$R^{21}$, $R^{22}$ and $R^{23}$ each independently represent hydrogen, substituted or unsubstituted alkyl, substituted or unsubstituted cycloalkyl, substituted or unsubstituted aryl, or $R^{22}$ and $R^{23}$ together represent the necessary atoms to close a heterocyclic nucleus or substituted heterocyclic nucleus;

Y represents $OR^{24}$ or $NR^{25}R^{26}$ or CN;

$R^{24}$ represents hydrogen, substituted or unsubstituted alkyl, substituted or unsubstituted cycloalkyl, substituted or unsubstituted aryl, $SO_2R^{27}$, $COR^{27}$, $CSR^{27}$, $POR^{27}R^{28}$;

$R^{25}$ or $R^{26}$ each independently represent hydrogen, substituted or unsubstituted alkyl, substituted or unsubstituted cycloalkyl, substituted or unsubstituted aryl, $SO_2R^{27}$, $COR^{27}$, $CSR^{27}$, $POR^{27}R^{28}$ or represent substituted or unsubstituted amino, or $R^{25}$ and $R^{26}$ together represent the necessary atoms to close a heterocyclic nucleus or substituted heterocyclic nucleus, or heterocyclic nucleus with an aliphatic or aromatic ring fused-on;

$R^{27}$ and $R^{28}$ each independently represent substituted or unsubstituted alkyl, substituted or unsubstituted cycloalkyl, substituted or unsubstituted alkenyl, substituted or unsubstituted aralkyl, substituted or unsubstituted aryl, substituted or unsubstituted alkyloxy, substituted or unsubstituted aryloxy, substituted or unsubstituted alkylthio, substituted or unsubstituted arylthio, substituted or unsubstituted amino, or a substituted or unsubstituted heterocyclic group or $R_{27}$ and $R_{28}$ together represent the necessary atoms to close a 5- or 6-membered ring, X represents N—Ar, N-Het, $CR^{29}R^{30}$, $N—NR^{31}R^{32}$ or $N—N{=}CR^{33}R^{34}$;

Ar represents an aromatic nucleus substituted in para position by a substituent chosen from the group consisting of substituted or unsubstituted amino, substituted or unsubstituted alkyloxy, substituted or unsubstituted aryloxy, substituted or unsubstituted alkylthio, substituted or unsubstituted arylthio, hydroxy, mercapto;

Het represents a substituted or unsubstituted heterocyclic ring;

$R^{29}$ and $R^{30}$ each independently represent hydrogen, substituted or unsubstituted alkyl, substituted or unsubstituted cycloalkyl, substituted or unsubstituted alkenyl, a substituted or unsubstituted heterocyclic group, cyano, halogen, $SO_2R_{27}$, $COR_{27}$, $CSR^{27}$, $POR^{27}R^{28}$, or $R^{29}$ and $R^{30}$ together represent the necessary atoms to close a substituted or unsubstituted ring including a substituted or unsubstituted heterocyclic ring;

$R^{31}$ represents a substituted or unsubstituted aromatic ring, including a substituted or unsubstituted aromatic heterocyclic ring;

$R^{32}$ represent hydrogen, substituted or unsubstituted alkyl, substituted or unsubstituted cycloalkyl, substituted or unsubstituted aryl, $SO_2R^{27}$, $COR^{27}$, $CSR^{27}$, $POR^{27}R^{28}$; and $R^{33}$ and $R^{34}$ each independently represent hydrogen, substituted or unsubstituted alkyl, substituted or unsubstituted cycloalkyl, substituted or unsubstituted aryl, or $R^{33}$ and $R^{34}$ together represent the necessary atoms to close a substituted or unsubstituted heterocyclic nucleus, or a heterocyclic nucleus with an aliphatic or aromatic ring fused-on.

21. Receiving element for use in a thermal dye transfer diffusion process, said element comprising a support sheet which is coated at one side with a dye-image-receiving layer, said dye-image-receiving layer containing a compound A-X wherein A stands for acyl, and X stands for the conjugated base of an acid with a $pKa \leqq 14$.

* * * * *